United States Patent [19]

Musgrave

[11] 3,999,321

[45] Dec. 28, 1976

[54] MAGAZINE GUIDE

[76] Inventor: Daniel D. Musgrave, 8201 Caraway St., Cabin John, Md. 20731

[22] Filed: Sept. 15, 1975

[21] Appl. No.: 613,514

[52] U.S. Cl. ..... 42/71 P; 42/1 A; 42/1 MH; 42/7

[51] Int. Cl.[2] ..... F41C 27/00

[58] Field of Search ..... 42/71 P, 6, 7, 50, 18, 42/22, 1 A, 1 MH

[56] References Cited

UNITED STATES PATENTS

| | | | |
|---|---|---|---|
| 804,984 | 11/1905 | Searle | 42/22 |
| 900,865 | 10/1908 | Louis | 42/7 |
| 3,710,411 | 1/1973 | Murguiondo | 42/1 MH |

*Primary Examiner*—Charles T. Jordan

[57] ABSTRACT

A guide to facilitate quick insertion of a magazine into a firearm which houses the magazine in a handle. The guide can be fabricated separately or it can be incorporated into the grips used on the handle. Luminescent indicators can be provided on the guide and on the magazine to help speed insertion when visibility is restricted.

6 Claims, 8 Drawing Figures

MAGAZINE GUIDE

Many firearms use detachable magazines which are removed when empty and are replaced by full magazines. The exchange of magazines sometimes takes place at a critical time, in combat for example, when it must be accomplished quickly. While newer military firearms sometimes have a magazine housing designed to facilitate the insertion of the magazine, there are in existence many millions of firearms, particularly pistols, which require excessive time to perform the insertion, especially if the user is tense or tired. This invention provides mechanical assistance to guide the magazine accurately into its receptacle. However it is not intended to limit the utility of the present invention to pistols. It can be used with any firearms which houses a detachable magazine in a handle. Certain existing submachineguns have the magazine so arranged, and such an arrangement could also be used with rifles firing cartridges having a relatively short overall length. However, it is not intended to limit the invention to use with existing firearms. It can be used with newly produced firearms as well.

The principal object of this invention is to provide a guide to facilitate the quick insertion of a magazine into a firearm.

This and other objects of the present invention will be apparent upon reference to the following specification, taken in connection with the accompanying drawings, wherein.

Figure 1:
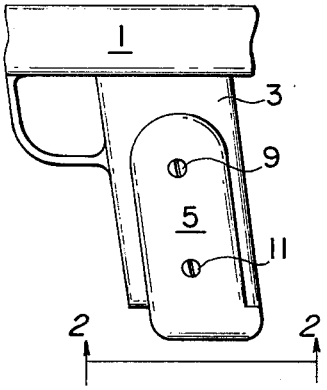
FIG. 1 is a side view of a portion of a firearm having a magazine guide affixed thereto.

Referring now to the drawings in detail, FIG. 1 shows a portion of a firearm 1, having a handle 3 to which is affixed a grip 5. The grip is affixed to the handle in the usual manner by screws 9 and 11. A similar grip 7 is affixed to the other side of the handle, as may be seen in FIG. 3.

Figure 3:
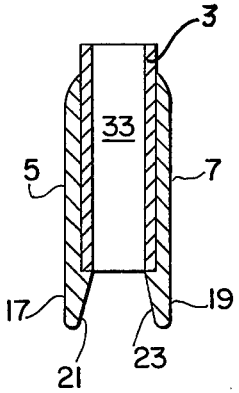
FIG. 3 is a partial cross-section of the structure shown in FIG. 1, looking toward the left on FIG. 1.

As shown in FIG. 3 grip 5 has an extension 17 which protrudes below handle 3, and grip 7 has a similar extension 19. The protruding extensions have beveled facing surfaces 21 and 23 respectively, which converge toward the open end of magazine receptacle 33 in handle 3.

Figure 5:
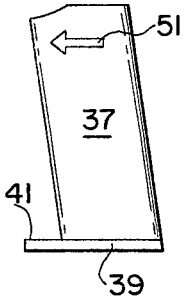
FIG. 5 is a side view of a typical magazine.
Figure 6:
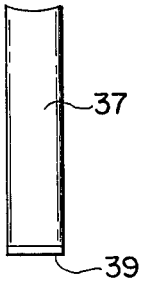
FIG. 6 is a rear view of a typical magazine.

FIG. 5 shows a side view of a typical magazine 37 having a floor plate 39 which has a forward extension 41 to provide a means to withdraw the magazine from the handle, if necessary. Magazines are usually withdrawn by gravity, upon release of a detent in the firearm. FIG. 6 is a rear view of the same magazine, showing the floor plate as substantially similar in width to the magazine body.

Figure 4:
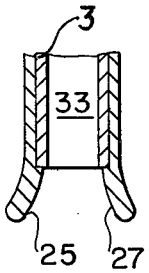
FIG. 4 shows an alternate configuration for the cross-section shown in FIG. 3.
Figure 7:
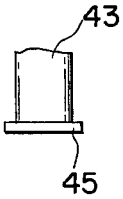
FIG. 7 is a rear view of a magazine having a different type of floor plate from that shown in FIG. 6.
Figure 8:
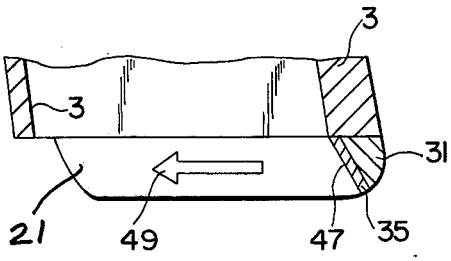
FIG. 8 shows the lower portion of the structure disclosed in FIG. 1, with the near side cut away.

FIG. 7 shows a portion of the rear of another typical magazine 43 in which the floor plate 45 is of considerably greater width than the body. As this magazine would not be compatible with the guide arrangement shown in FIG 3, a modification such as that shown in FIG. 4, may be used. The grip extensions have curved surfaces 25 and 27, with sufficient distance between them to permit floor plate 45 to move close to the open end of receptacle 33.

Figure 2:
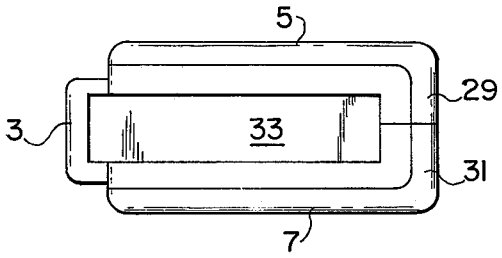
FIG. 2 is a bottom view of part of FIG. 1, as indicated by the arrows 2—2 on FIG. 1.

The surfaces of the grip extensions thus far described are capable of guiding a magazine laterally toward receptacle 33. It is also necessary to guide it in another plane, that is from front to rear of the firearm. To do this the grip extensions have portions 29 and 31 extending around the rear of the open end as shown in FIG. 2. The surface of these extensions is inclined relative to magazine receptacle 33 as indicated at 47. In some cases it might be useful to mount a magnet 35 in this location to assist in positioning a magazine. It would also be possible to make the two grips in one piece by connecting them at portions 29 and 31.

To assist in positioning a magazine during conditions of poor visibility, a luminescent indicator 49 may be placed on one of the guide surfaces such as 21. A similar indicator 51 may be placed on magazine 37. The indicator on the magazine can also indicate the correct way to install it relative to the firearm.

In operation the user would presumably be holding the handle with one hand. With the other hand he would insert a magazine, feed mouth up, between the lateral guides and then bring it back against the rear guide. An upward push would then cause it to enter the receptacle. Most magazines are steel, and the magnet would attract such a magazine to contact the rear guide. The described operation could probably be performed by a skilled user while looking in another direction. If the user requires visual guidance to install the magazine and visibility is restricted by darkness, fog or smoke, the indicators on the guide and the magazine will provide visual guidance.

It is desired to point out that the word firearm is used herein in the broad sense, and is not intended to be construed as limited to any particular class. The illustrations are exemplary, and have been chosen only for purposes of disclosure. The embodiment shown should not be considered limiting, as the principle of the invention can be applied to various classes of firearms.

There is thus disclosed a simple guide which can be applied to existing or future firearms, to facilitate quick insertion of a magazine into its housing.

What I claim is:

1. On a firearm having a hollow handle adapted for insertion of magazine therein via an open end, means to guide said magazine toward said end for insertion into said handle, said means comprising an extension of at least one grip affixed to said handle.

2. A device as set forth in claim 1 further characterized by said means being removable from said firearm.

3. A device as set forth in claim 1 further characterized by a luminescent indicator on said means.

4. A device as set forth in claim 1 further characterized by a luminescent indicator on said magazine.

5. A device as set forth in claim 4 further characterized by said indicator being capable of identifying the orientation of said magazine relative to a viewer.

6. A device as set forth in claim 1 further characterized by a magnet positionally adapted for retaining a magazine comprising magnetic material against said means.

* * * * *